United States Patent [19]

Mulholland

[11] Patent Number: 4,813,746

[45] Date of Patent: Mar. 21, 1989

[54] WHEELCHAIR PELVIC SUPPORT ARMS

[75] Inventor: Lawrence K. Mulholland, Santa Paula, Calif.

[73] Assignee: Mulholland Designs, Inc., Wilmington, Del.

[21] Appl. No.: 90,018

[22] Filed: Aug. 27, 1987

[51] Int. Cl.[4] ..... A47C 31/00

[52] U.S. Cl. ..... 297/488; 128/78; 297/464

[58] Field of Search ..... 297/487, 488, 467; 128/68, 69, 70, 78, 134

[56] References Cited

U.S. PATENT DOCUMENTS

| | | | |
|---|---|---|---|
| 951,560 | 3/1910 | Eaton | 128/75 |
| 2,492,880 | 12/1949 | Nichols | 297/487 |
| 3,409,326 | 11/1968 | Kerner | 297/488 |
| 3,694,029 | 9/1972 | Noble et al. | 297/467 |
| 3,764,180 | 10/1973 | Mulholland | 297/384 |
| 3,815,586 | 6/1974 | Kazik | 128/70 |
| 4,073,537 | 2/1978 | Hammersburg | 297/384 |
| 4,300,249 | 11/1981 | Taylor | 128/70 |
| 4,300,799 | 11/1981 | Cunningham | 297/487 |
| 4,579,191 | 4/1986 | Klee et al. | 297/488 |
| 4,593,929 | 6/1986 | Williams | 297/467 |
| 4,617,919 | 10/1986 | Suhre | 128/134 |
| 4,623,194 | 11/1986 | Pillot | 297/488 |
| 4,653,809 | 3/1987 | Czernakowski et al. | 297/487 |
| 4,658,807 | 4/1987 | Swain | 128/78 |
| 4,700,632 | 10/1987 | Schmutz | 297/487 |

FOREIGN PATENT DOCUMENTS

| | | | |
|---|---|---|---|
| 952421 | 8/1974 | Canada | 297/487 |
| 2150525 | 4/1972 | Fed. Rep. of Germany | 297/467 |
| 5566 | of 1901 | United Kingdom | 297/488 |

*Primary Examiner*—Charles Pearson
*Assistant Examiner*—Lane E. Hardwicke
*Attorney, Agent, or Firm*—Kenneth J. Hovet

[57] ABSTRACT

An angular bar is mounted on each opposing lower portion of a wheelchair frame for securement of the pelvis of a person seated in the wheelchair. Each bar has a side portion that extends across the lateral regions of the hip and a front portion that extends in front of the hips above the thighs. Universal adjustment means with a quick release mechanism are provided for independent adjustment of each arm.

9 Claims, 4 Drawing Sheets

WHEELCHAIR PELVIC SUPPORT ARMS

BACKGROUND OF THE INVENTION

1. Field of the Invention

The present invention relates to wheelchairs and, more particularly, to means on a wheelchair for effectively orienting and securing the pelvis of a person seated in a wheelchair.

2. Brief Description of the Prior Art

Probably the most notorious device for securing a patient's hips to a wheelchair is a seat belt. Such a device, however, provides no lateral support or pelvic orientation capability. It merely functions as a restraint which, if secured tightly, inhibits blood circulation and possibly damages tissue.

Large torso pads mounted on the sides of a wheelchair are shown in U.S. Pat. No. 3,815,586. The pads are used for correcting scoliosis. Similar pads are shown in U.S. Pat. No. 4,073,537. These pads are adjustable and can impinge the sides of one's torso, hip or thigh. Such lateral support is an improvement over seat belts, but gives no frontal stability or overall pelvic control.

U.S. Pat. No. 4,617,919 describes a wheelchair that provides a variety of posture support pads for a patient's neck, shoulders, trunk and thighs. Again, however, the trunk pads simply contact the sides of a user's hips and thereby provide only limited pelvic support.

SUMMARY OF THE INVENTION

The present invention provides a wheelchair having means for secure and accurate pelvic positioning. Curved support arms lock over iliac spin regions of the pelvis. The arms have adjustment means for securing their location in an infinite variety of positions over a patient's hips. This provides a degree of pelvic control not attainable in the prior art.

DESCRIPTION OF THE PREFERRED EMBODIMENTS

Figure 1:
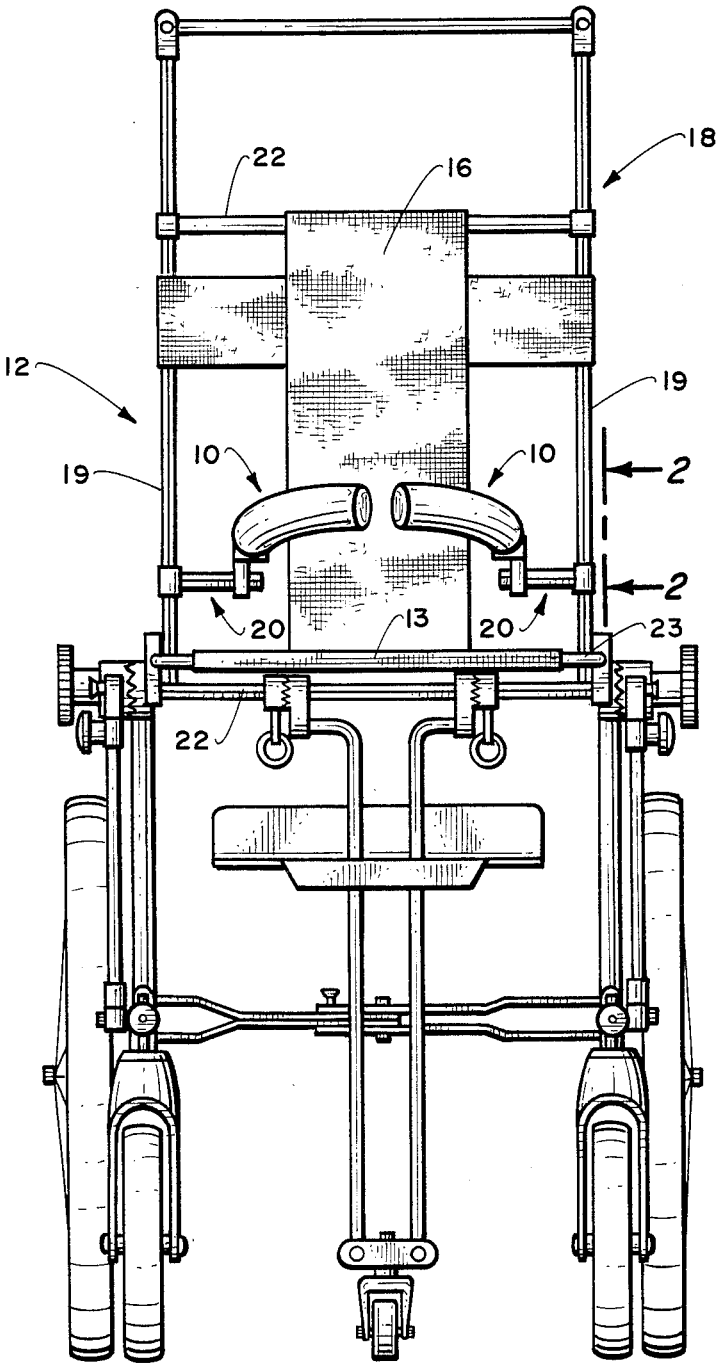
FIG. 1 is a front elevational view of a wheelchair with pelvic support bars attached and in a constraint position.

With reference now to the drawings, numeral 10 of FIG. 1 shows generally the support arms of the invention attached to a wheelchair 12. The wheelchair includes a seat 13 having an overall rectangular shape with opposing side edges 14 and a back edge 15. The seat is supported by a U-shaped frame member 23 of wheelchair frame 18.

Extending upwardly from adjacent the back edge 15 is backrest 16. The backrest is supported by cross-bars 22 of the overall frame 18 with opposing ends thereof secured to upstanding frame bars 19. The frame bars are located proximate each opposing back corner 17 of the seat. Adjustment means 20 is used to attach each arm to a respective frame bar.

The invention contemplates the use of two arms which are mirror images of each other. They are juxtaposed facing each other on opposing sides of the wheelchair above the seat and adjacent the hip region of a person seated in the wheelchair. The arms comprise an elongated shaft 21 having a proximal end 24 which connects with the adjustment means. The proximal end merges into a lateral portion 26 followed by a curved portion 28. The curved portion extends into a distal segment 30 which terminates at free end 32.

The proximal end and lateral portion preferably form a continuous straight segment of the shaft. The distal segment forms a shorter straight section. The angle "a" between the longitudinal axis of the lateral portion and distal segment can range between 70° and 110°. Except for the proximal end 24, the shaft 21 is preferably covered with cushioned sleeves 34. At least part of the proximal end should be circular in cross-section.

Figure 2:
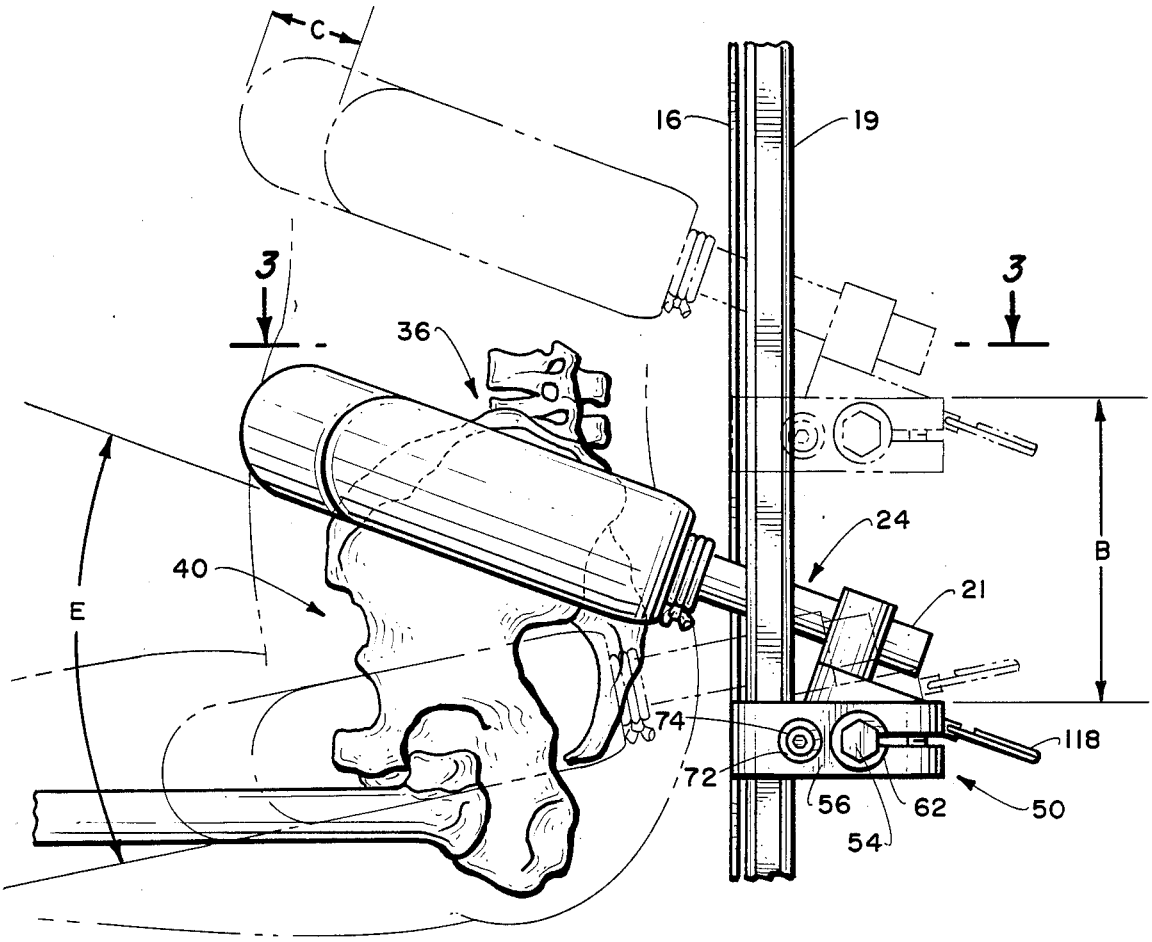
FIG. 2 is an enlarged fragmentary side elevational view taken along lines 2—2 of FIG. 1.
Figure 6:
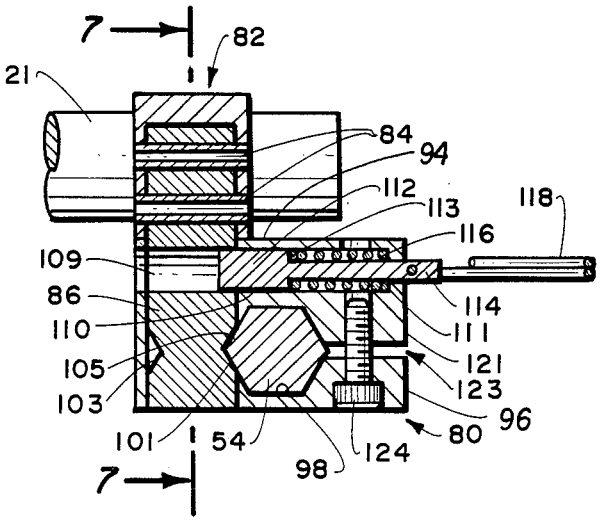
FIG. 6 is a cross-sectional view taken along lines 6—6 of FIG. 3 rotated to a horizontal upright position for clarity.
Figure 7:
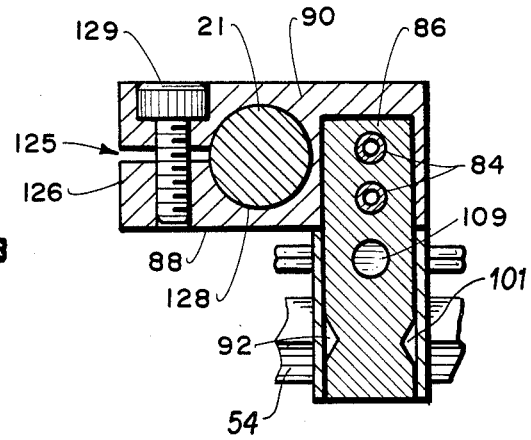
FIG. 7 is a cross-sectional view taken along lines 7—7 of FIG. 6.
Figure 3:
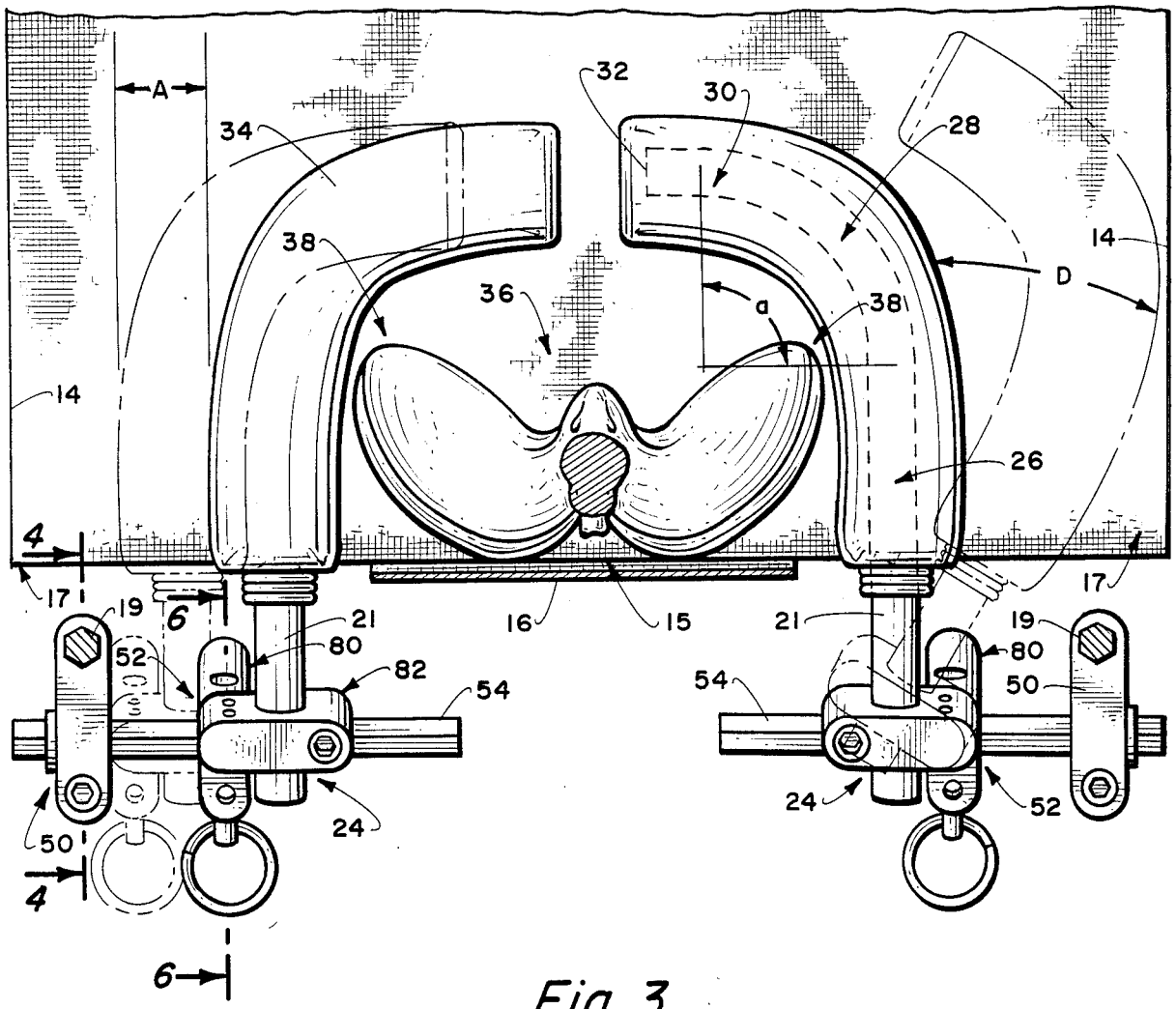
FIG. 3 is a plan view taken along lines 3—3 of FIG. 2.
Figure 4:
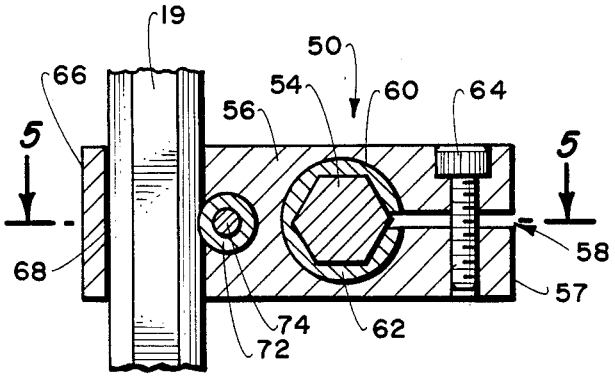
FIG. 4 is a cross-sectional view taken along lines 4—4 of FIG. 3.
Figure 5:
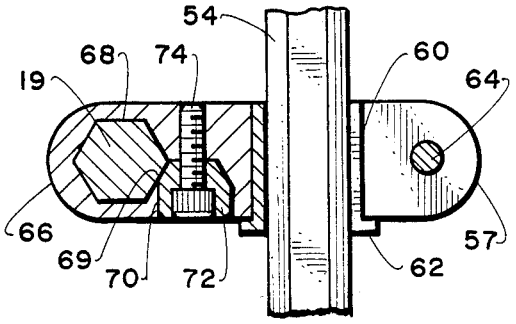
FIG. 5 is a cross-sectional view taken along lines 5—5 of FIG. 4.
Figure 8:
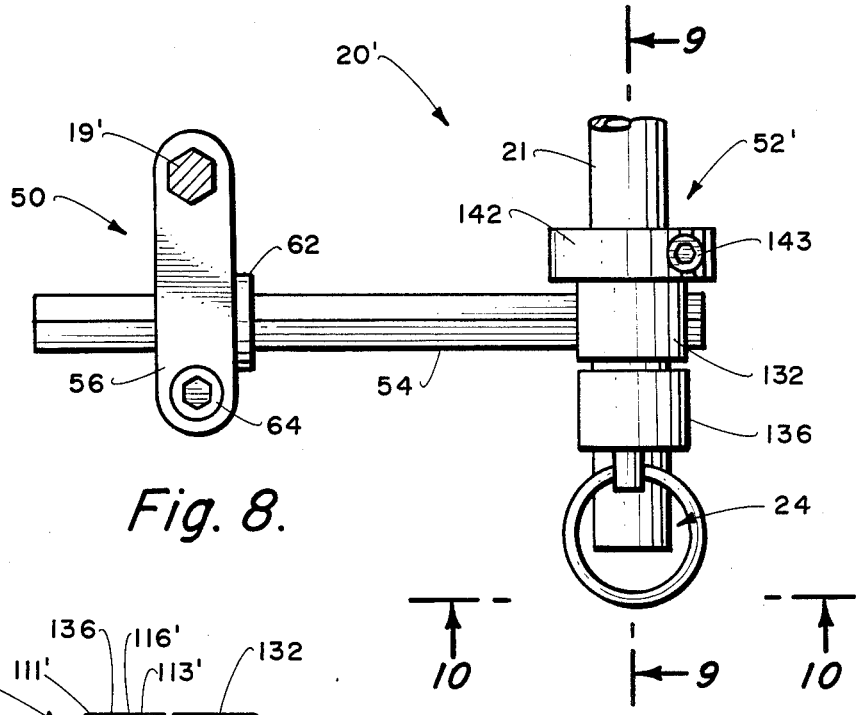
FIG. 8 is a top plan view of an alternative arm adjustment means which can be utilized with various wheelchair designs.

As best seen in FIGS. 2 and 3, the arms adjustably interact with the pelvic region of a person seated in the wheelchair to form a hip constraint area 36. The area is defined as the space between the opposing arms 10, the seat area below the arms and the backrest area behind the arms.

The configuration of each arm and its universal adjustment capability permit the arms to act upon the lateral areas 38 of a patient's pelvis for the desired constraint and orientation. With particular reference to FIG. 2, the curved and lateral portions of each arm are depicted in engagement with various portions of the sub-anterior-superior iliac spine region 40 of the pelvis to securely position the patient's hips within the constraint area.

Adjustment means 20 provides the universally adjustable connection between each arm and the wheelchair frame. In the FIGS. 1–7 embodiment, its basic components are a frame attaching clamp 50 and a slide block assembly 52. Included with the slide block assembly is a transverse rod 54. The rod connects the assembly with the frame attaching clamp which, in turn, is attached to the wheelchair frame.

The clamp comprises a clamping block 56 which has an open slot 58 extending across the block width from a first end 57 to a rod opening 60. The rod opening also extends across the width of the block and includes a split sleeve 62. As shown, the sleeve adapts the round opening 60 to the hexagonal cross-section of rod 54 and allows the rod and sleeve to rotate within the opening as shown by arrows E in FIG. 2.

Adjacent the first end 57 is a threaded fastener 64 extending across the slot 58. Tightening the fastener will close both the slot and split sleeve and secure the block to the transverse rod. Loosening the fastener will permit lateral movement of the rod, as well as the aforementioned rotational movement.

Proximate second end 66 of block 56 is bar opening 68 through which frame bar 19 extends. The bar opening extends through the thickness of the block and has a cross-sectional shape in correspondence with the cross-sectional shape of the frame bar.

Extending transverse to the bar opening and intersecting a segment 69 thereof is a collar opening 70. A corresponding collar 72 fits into the opening and is held therein by collar fastener 74. The fastener is threadably secured to the block and, when tightened, forces a portion of the collar to frictionally engage a corresponding portion of bar 19 through segment 69. When the collar fastener is loosened, the clamp (including the arm) may be moved vertically along the bar as shown in phantom in FIG. 2 and by arrows B.

The slide block assembly 52 comprises a pivot connector member 80 and an arm connector means 82. Fixed to the arm connector means by pegs 84 is pivot shaft 86. The pivot shaft extends perpendicularly from lower face 88 of connector block 90 into corresponding pivot opening 92 of the pivot connector member.

The pivot opening extends perpendicular to upper face 94 through pivot block 96. Extending transversly across the width of the pivot block is a central rod opening 98. This opening intersects pivot opening 92 and forms a rodway 101.

Pivot shaft 86 is provided with an annular notch 103 about its lower periphery which corresponds in shape to an angular segment of the transverse rod cross-section. The rodway and notch are coextensive so that the angular segment will extend through the rodway and into the notch. With the round pivot shaft 86 and annular notch 103, it can be seen that the pivot shaft can be rotated while the shaft and transverse rod are engaged.

The connector member 80 further includes a releasable securement means. This comprises an engagement opening 109 extending across the pivot shaft diameter which is coextensive with pin opening 110 of pivot block 96. A release pin 112 is provided for reciprocation within the openings. It includes an annular shoulder 113 from which extends a reduced diameter portion 114. Surrounding the reduced diameter portion is compression spring 116 which abuts between shoulder 113 and end 111 of the pin opening. The spring functions to bias the pin into the engagement opening.

When the shaft engagement opening and pivot block pin opening are in alignment, the spring 116 will move the release pin into the engagement opening. This will lock the arm connector means into a predetermined orientation. Finger grasping means, shown as ring 118, is attached to pin portion 114 for pulling the pin against the spring bias and out of the engagement opening.

Extending across the width of the pivot block 96 is rod slot 123. It extends from outer end 121 to central rod opening 98. With threaded rod fastener 124 extending across the slot, opening 98 may be enlarged to loosen frictional engagement with rod 54. As so enlarged, the pivot connector member (and adjoining arm connector means) may be moved along the longitudinal extent of the transverse rod as shown by arrows A in FIG. 3.

In a similar fashion, arm slot 125 extends across the width of connector block 90 from securement face 126 to arm opening 128. The arm opening also extends across the width of the block. Its diameter is enlarged or contracted by threaded arm fastener 129 which extends across the arm slot. Loosening the arm fastener allows axial movement of distal portion 24 of shaft 21 through the arm opening as shown by arrows C in FIG. 2. With opening 128 enlarged, the arm may also be rotated to direct the distal segment 30 in any desired angular orientation.

In operation, ring 118 will be pulled to remove release pin 112 from engagement opening 109 and allow the arms 10 to swing out into an open position as shown in phantom and by arrows D in FIG. 3. A person will then be positioned into a seated position with the trunk region firmly against backrest 16. At this point, it will be appreciated that the wheelchair may include other support means, such as trunk, neck and shoulder pads, which may be secured against the person's body.

Thereafter, the arms will be swung into a closed position to define an initial constraint area 36. The arms are locked in the closed constraint position as a result of the pin 112 entering engagement opening 109. Note that the longitudinal axis of the engagement opening will be in alignment with the longitudinal axis of the proximal and lateral portions of the arms when they are in a closed position. In this manner, the arms will be locked in the operative constraint position but, can be quickly and easily released to an open position for egress from the chair.

It will further be appreciated that the invention can be modified for attachment to a variety of wheelchair designs. Most commonly, the upstanding frame bars will be altered to include securement means for attachment to appropriate parts of an existing wheelchair frame. Typically, the bars 19' will be located behind the chair backrest. The highly versatile adjustment means will function to locate the arms in front of the backrest above the seat to define the desired hip constraint area. Also, the slide block assembly can be modified to facilitate axial rotation of the arm via a quick release means.

With reference now to FIGS. 8–11, a modified adjustment means 20' is shown comprising frame bar attaching clamp 50 and slide block assembly 52'. Included with the slide block assembly is transverse rod 54 which connects the assembly with the clamp. Note the clamp is attached to the aforementioned upstanding frame bar 19' in the same manner as before. However, the transverse rod extends outwardly therefrom to properly locate the slide block assembly whereby it can direct the arm 10 into the desired hip constraint position.

The modified slide block assembly 52' includes an arm rotation block 132 having a lower side aperture 133 for receiving and stationarily securing the block to the end section of transverse rod 54. Proximate the block midportion is axial opening 134 which extends through the block thickness perpendicular to side aperture 133. The proximal end 24 of arm 10 extends through the axial opening and freely rotates therein as shown by arrows F.

Clamped to the arm proximal end adjacent the outer face 135 of block 132 is lock member 136. The lock member is provided with an arm slot 137 that extends from a lower end 138 to an arm lock opening 139. The opening is about identical to, and coextensive with, axial opening 134 so that proximal end 24 will extend therethrough. Threaded fastener 140 extends across slot 137. When tightened, the fastener functions to draw the bifurcated parts of lower end 138 into frictional engagement with the arm proximal end.

In a clamping action similar to the above, split collar 142 encircles proximal end 24 adjacent the inner face 141 of rotation block 132. Tightening fastener 143 will clamp the collar about the proximal end. With the collar and lock member secured to the proximal end at opposing faces of block 132, arm movement along its longitudinal axis will be prevented. Of course, loosening of the collar and lock member will permit longitudinal adjustment of the arm as dictated by a patient's needs. Such loosening will also permit rotation of the arm and angular adjustment of the arm distal segment 30.

Figure 9:
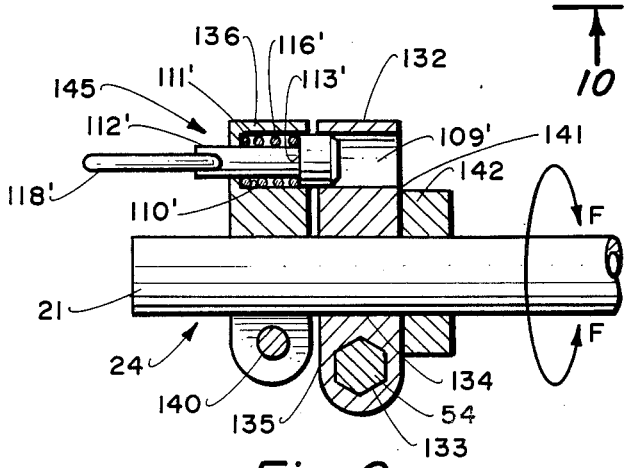
FIG. 9 is a cross-sectional view taken along lines 9—9 of FIG. 8.
Figure 10:
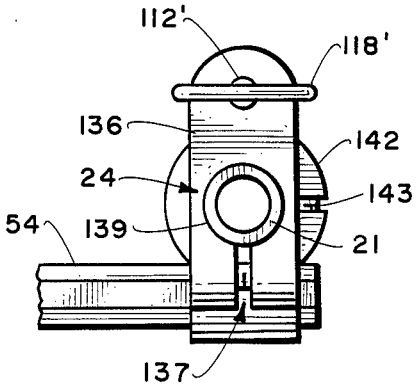
FIG. 10 is an end elevational view taken along lines 10—10 of FIG. 8.
Figure 11:
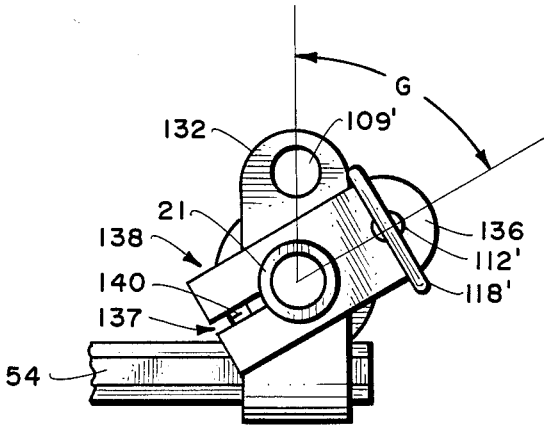
FIG. 11 is an end elevational view similar to FIG. 10 with the lock member in a release position.

After the aforementioned semi-permanent arm adjustments have been made, a releasable locking means 145 is provided to maintain the arm in position. As best shown in FIG. 9, such means is substantially identical to the releasable securement means used with pivot connector member 80.

When the arm 10 is in a locked pelvis constraint position, engagement opening 109' of stationary arm rotation block 132 will be in alignment with pin opening 110' of lock member 136. Release pin 112' reciprocates within the openings and includes a shoulder 113'. Spring 116' encircles a reduced diameter portion of the pin and is compressed between pin opening end 111' and shoulder 113'. The spring functions to bias the pin into engagement with opening 109' unless drawn therefrom by pulling outwardly on ring 118'.

When pin 112' is withdrawn, the arm can be rotated within axial opening 134 of stationary arm rotation block 132 as shown by arrows F and G. This allows a wheelchair user to have the arms rotate from a locked constraint position shown in FIGS. 8–10, to a release position as shown by arrows G in FIG. 11.

With reference to FIG. 1, both arms are shown in a typical constraint position. In a release position, the lock member 136 would be rotated until the distal segments point up and away from interference with a patient's movement in and out of the wheelchair.

In both the FIGS. 1–7 and 8–11 embodiments, the constraint arms can be custom-fitted to each patient's size and needs in a semi-permanent manner. Yet, easy disengagement for egress is possible and further adjustments can always be made as the wheelchair user's needs change.

With the defined configuration of each arm and the above-described universal adjustment capability, it can be seen that all types of abnormal pelvic rotation, obliquity and tilt can be controlled. With patients having serious neuro-muscular deficits, such as spasticity, lack of pelvic control over a prolonged period of time could result in the development of life-threatening deformities. The present invention seeks to overcome the above and provide an effective means for pelvic control not heretofore possible.

While the invention has been described with respect to a preferred embodiment, it will be apparent to those skilled in the art that various modifications may be made without departing from the scope and spirit of the invention. Accordingly, it is to be understood that the invention is not to be limited by the specific embodiments described, but only by the scope of the appended claims.

I claim:

1. A hip control apparatus on a chair having a seat and backrest supported by a frame comprising:

a pair of arms structured to constrain the lateral areas of the pelvis of a person seated in the chair wherein each of said arms comprises an elongated shaft at least a portion of which is covered with a cushioning means, each arm including a curved portion and a distal segment that provides forward constraint of said hip and a lateral portion that provides lateral constraint of said hip; and, each of said arms having an adjustment means for connecting each arm to opposing sides of said chair, said adjustment means comprising a frame attaching clamp interconnected with a slide block assembly with each arm being attached to a respective slide block assembly which includes a transverse rod connecting said assembly with said frame attaching clamp, said slide block assembly further including a pivot connector member with a releasable securement means for releasably locking each attached arm at a predetermined orientation and an arm connector means for connecting said attached arm to said assembly, said arm connector means having a pivot shaft extending into said pivot connector member, said shaft being engageable with said releasable securement means.

2. The apparatus of claim 1 wherein said releasable securement means includes a spring-biased pin extending from said pivot connector member into an engagement opening in said shaft.

3. The apparatus of claim 2 wherein the longitudinal axis of said engagement opening is in alignment with the longitudinal axis of said arm lateral portion.

4. The apparatus of claim 1 wherein said frame attaching clamp includes a clamping block having an open slot extending across the width of said block from a first end to a rod opening which extends through the width of said block.

5. The apparatus of claim 4 wherein said rod opening is round and includes a split sleeve having a round exterior and polygonal interior cross-sectional shape.

6. A hip control apparatus on a chair having a seat and backrest supported by a frame comprising:

a pair of arms structured to constrain the lateral areas of the pelvis of a person seated in the chair wherein each of said arms comprises an elongated shaft at least a portion of which is covered with a cushioning means, each arm including a curved portion and a distal segment that provides forward constraint of said hip and a lateral portion that provides lateral constraint of said hip; and, an adjustment means for each of said arms for connecting each arm to opposing sides of said chair, said adjustment means comprising a frame attaching clamp interconnected with a slide block assembly with each arm being attached to a respective slide block assembly which includes a transverse rod connecting said assembly with said frame attaching clamp, said slide block assembly further including an arm rotation block secured to said transverse rod, said arm rotation block connecting an attached arm to said assembly.

7. The apparatus of claim 6 wherein each of said arms includes a proximal end and said arm rotation block includes an axial opening through which said proximal end extends.

8. The apparatus of claim 7 wherein said arm rotation block has two opposing faces, including a collar clamped to said proximal end adjacent one of said faces and a lock member clamped to said proximal end adjacent the other of said faces.

9. The apparatus of claim 8 wherein said lock member includes a releasable locking means for preventing longitudinal rotation of said attached arm.

* * * * *